US009308418B2

(12) United States Patent
Davis et al.

(10) Patent No.: US 9,308,418 B2
(45) Date of Patent: Apr. 12, 2016

(54) SWIMMING PADDLE

(71) Applicants: Kathleen Davis, Los Angeles, CA (US); Don Reardon, Portland, OR (US); Damon Clegg, Portland, OR (US)

(72) Inventors: Kathleen Davis, Los Angeles, CA (US); Don Reardon, Portland, OR (US); Damon Clegg, Portland, OR (US)

( * ) Notice: Subject to any disclaimer, the term of this patent is extended or adjusted under 35 U.S.C. 154(b) by 0 days.

(21) Appl. No.: 14/157,443

(22) Filed: Jan. 16, 2014

(65) Prior Publication Data

US 2015/0196807 A1 Jul. 16, 2015

(51) Int. Cl.
*A63B 31/10* (2006.01)

(52) U.S. Cl.
CPC ..... *A63B 31/10* (2013.01); *A63B 2209/00* (2013.01); *A63B 2209/10* (2013.01); *A63B 2225/605* (2013.01)

(58) Field of Classification Search
CPC ..... A63B 35/02; A63B 31/10; A63B 31/08
See application file for complete search history.

(56) References Cited

U.S. PATENT DOCUMENTS

| | | | | |
|---|---|---|---|---|
| 2,313,979 | A * | 3/1943 | Tuma | A63B 31/08 441/58 |
| 2,389,196 | A | 11/1945 | Harmon | |
| 2,555,969 | A | 6/1951 | Holcombe | |
| 2,810,138 | A | 10/1957 | Cochran | |
| D196,689 | S | 10/1963 | O'Reilly | |
| 3,146,470 | A | 9/1964 | Hamblin | |
| 3,182,657 | A | 5/1965 | Zurbuchen | |
| D204,524 | S | 4/1966 | Engler | |
| 3,258,794 | A | 7/1966 | Goodwin et al. | |
| 3,261,040 | A | 7/1966 | Olson | |
| 3,263,248 | A | 8/1966 | Wendorf | |
| 3,328,812 | A | 7/1967 | Berthiot | |
| 3,382,515 | A | 5/1968 | McClure | |
| 3,397,414 | A | 8/1968 | Webb | |
| 3,405,413 | A | 10/1968 | Manis | |
| 3,407,419 | A | 10/1968 | Drummond | |
| 3,408,670 | A | 11/1968 | Wolfe | |
| 3,417,415 | A | 12/1968 | Kozak | |
| 3,510,894 | A | 5/1970 | Eriksen | |
| 3,516,668 | A | 6/1970 | Kirk | |
| 3,529,313 | A | 9/1970 | Girden | |
| 3,599,258 | A | 8/1971 | Murawski | |
| D222,708 | S | 12/1971 | Balla | |
| 3,733,630 | A | 5/1973 | Bagley | |
| 3,742,539 | A | 7/1973 | Okuniewski et al. | |
| 3,765,042 | A | 10/1973 | Montrella | |

(Continued)

FOREIGN PATENT DOCUMENTS

| | | | |
|---|---|---|---|
| BR | PI1000548-0 | A2 | 1/2011 |
| CN | 243022 | Y | 6/2001 |

(Continued)

OTHER PUBLICATIONS

Swim-mfg Co., Ltd., Specification page for Hand Paddles, copyright 2007, retrieved from the Internet at <http://www.swim-mfg.com/swim/content-handpad.html> on Oct. 11, 2013.

Barracuda Hand Paddles at SwimOutlet.com, retrieved from <http://www.swimoutlet.com/product_p/18026.htm>.

*Primary Examiner* — Edwin Swinehart

(74) *Attorney, Agent, or Firm* — Katten Muchin Rosenman LLP

(57) ABSTRACT

The present invention relates to swimming paddles used for strength training in fitness swimming and performance swimming. A swimming paddle comprises an oversized paddle body having top and bottom surfaces, proximal and distal sides, and lateral and medial sides, the paddle body having a hand placement portion for placing a hand thereon. The swimming paddle further comprises a hand securing portion configured to secure a hand to the paddle body. A portion of a side of the paddle body is scalloped.

10 Claims, 11 Drawing Sheets

(56) References Cited

U.S. PATENT DOCUMENTS

| | | | | |
|---|---|---|---|---|
| 3,768,431 | A | 10/1973 | Picken | |
| 3,789,447 | A | 2/1974 | Lavallee | |
| 3,835,493 | A | 9/1974 | Grivna | |
| 3,889,308 | A | 6/1975 | Persson | |
| 3,913,907 | A | 10/1975 | Baker | |
| 3,922,740 | A | 12/1975 | Potter | |
| 3,942,205 | A | 3/1976 | Lind | |
| 3,945,068 | A | 3/1976 | Carbonero | |
| RE28,855 | E | 6/1976 | Montrella | |
| 4,055,174 | A | 10/1977 | LeVasseur | |
| D256,604 | S | 8/1980 | Arzoian | |
| 4,233,925 | A | 11/1980 | Proctor | |
| 4,240,171 | A | 12/1980 | Parsons | |
| 4,264,994 | A | 5/1981 | Carbone | |
| D261,023 | S | 9/1981 | Pesarek | |
| D262,477 | S | 12/1981 | Lewis et al. | |
| D262,817 | S | 1/1982 | Griffith | |
| 4,345,335 | A | 8/1982 | Shih-Li | |
| D271,227 | S | 11/1983 | Francisco | |
| D274,744 | S | 7/1984 | Smithers | |
| 4,493,663 | A * | 1/1985 | Richmond | 440/101 |
| 4,509,744 | A | 4/1985 | Beasley | |
| 4,548,588 | A | 10/1985 | Kosuge | |
| 4,618,328 | A | 10/1986 | Chi | |
| D286,904 | S | 11/1986 | Kim | |
| 4,632,387 | A | 12/1986 | Guzman | |
| 4,669,991 | A | 6/1987 | Southworth | |
| 4,676,760 | A | 6/1987 | Massbaum | |
| 4,685,667 | A | 8/1987 | McDonald | |
| 4,690,651 | A | 9/1987 | Samson et al. | |
| 4,746,313 | A | 5/1988 | Bray et al. | |
| 4,755,158 | A | 7/1988 | Wise | |
| D299,261 | S | 1/1989 | Gruenspecht | |
| D299,262 | S | 1/1989 | Gruenspecht | |
| D300,341 | S | 3/1989 | Brom | |
| 4,832,643 | A | 5/1989 | Schoofs | |
| 4,892,496 | A | 1/1990 | Vondruska | |
| 4,913,418 | A | 4/1990 | Schlueter et al. | |
| 4,923,418 | A | 5/1990 | Hoffman | |
| 4,932,911 | A | 6/1990 | Albrecht | |
| D310,255 | S | 8/1990 | Gammon et al. | |
| 5,009,623 | A | 4/1991 | Lueschen | |
| D318,894 | S | 8/1991 | Harling et al. | |
| D321,547 | S | 11/1991 | Albrecht et al. | |
| 5,114,371 | A | 5/1992 | Alonzo | |
| 5,139,450 | A | 8/1992 | Steele | |
| D329,633 | S | 9/1992 | Rodgers | |
| 5,147,233 | A | 9/1992 | Hannula | |
| 5,167,551 | A | 12/1992 | Davis | |
| D338,255 | S | 8/1993 | Goodell | |
| D342,773 | S | 12/1993 | Chen et al. | |
| 5,288,254 | A | 2/1994 | Elson | |
| 5,304,080 | A | 4/1994 | Dilger | |
| 5,348,503 | A | 9/1994 | Fechtner | |
| 5,356,322 | A | 10/1994 | Bakalis | |
| D353,573 | S | 12/1994 | Liveoak | |
| 5,376,036 | A | 12/1994 | Hull | |
| 5,419,727 | A | 5/1995 | Lemley | |
| 5,429,535 | A | 7/1995 | Liese | |
| D363,153 | S | 10/1995 | Brasseur | |
| D363,754 | S | 10/1995 | Johnson | |
| D364,951 | S | 12/1995 | Martello | |
| 5,511,998 | A | 4/1996 | Johnson | |
| 5,516,319 | A | 5/1996 | Nessel | |
| D378,307 | S | 3/1997 | Desveaux | |
| D378,537 | S | 3/1997 | Kamark | |
| 5,641,316 | A | 6/1997 | Bakalis | |
| 5,643,027 | A | 7/1997 | Evans et al. | |
| 5,647,783 | A | 7/1997 | Nessel | |
| 5,649,845 | A | 7/1997 | Fechtner | |
| 5,651,710 | A | 7/1997 | Rives | |
| 5,658,224 | A | 8/1997 | Betrock | |
| 5,663,897 | A | 9/1997 | Geiser | |
| D397,187 | S | 8/1998 | Reeder | |
| 5,795,201 | A | 8/1998 | Tibbetts | |
| 5,820,526 | A | 10/1998 | Hoffman | |
| 5,842,896 | A | 12/1998 | Liveoak | |
| D405,146 | S | 2/1999 | Picciolo | |
| D407,459 | S | 3/1999 | Hudson | |
| D412,195 | S | 7/1999 | Falconer | |
| D412,352 | S | 7/1999 | Falconer | |
| D412,353 | S | 7/1999 | Falconer | |
| D416,601 | S | 11/1999 | Gurley | |
| 6,019,650 | A | 2/2000 | Rives et al. | |
| 6,050,925 | A | 4/2000 | Irvin et al. | |
| 6,088,835 | A | 7/2000 | Perkins et al. | |
| D429,305 | S | 8/2000 | Harwell, IV | |
| D437,912 | S | 2/2001 | Chiang | |
| D438,278 | S | 2/2001 | McCarthy | |
| 6,183,396 | B1 | 2/2001 | Reynier | |
| D439,299 | S | 3/2001 | Chiang | |
| D443,013 | S | 5/2001 | Chiang | |
| D445,473 | S | 7/2001 | Harwell | |
| 6,264,519 | B1 | 7/2001 | Brown | |
| 6,315,700 | B1 | 11/2001 | Shifferaw | |
| 6,342,031 | B1 | 1/2002 | Vaughan | |
| 6,375,531 | B1 | 4/2002 | Melius | |
| 6,398,603 | B1 | 6/2002 | Brown | |
| D462,410 | S | 9/2002 | Chiang | |
| 6,482,058 | B2 | 11/2002 | Sanso et al. | |
| D484,559 | S | 12/2003 | Peek | |
| 6,685,521 | B1 | 2/2004 | Melius | |
| 6,709,306 | B2 | 3/2004 | Brown | |
| 6,743,023 | B2 | 6/2004 | Topolski | |
| 6,899,581 | B1 | 5/2005 | Nokes | |
| 7,033,235 | B1 | 4/2006 | Slimi | |
| 7,044,819 | B1 | 5/2006 | Dulemba | |
| D529,117 | S | 9/2006 | Chiang | |
| D529,569 | S | 10/2006 | Chiang | |
| 7,125,299 | B1 * | 10/2006 | Ross, Jr. | 441/56 |
| 7,147,526 | B1 | 12/2006 | Chiang | |
| 7,179,146 | B2 | 2/2007 | Johnson | |
| 7,267,595 | B1 | 9/2007 | Hall | |
| 7,361,070 | B2 | 4/2008 | Bolster | |
| D578,596 | S | 10/2008 | Hicks | |
| D585,104 | S | 1/2009 | McCarthy | |
| 7,494,395 | B2 | 2/2009 | Krikliwy et al. | |
| 7,566,252 | B2 | 7/2009 | Bolster | |
| D599,429 | S | 9/2009 | King | |
| 7,582,045 | B1 | 9/2009 | Lombardi et al. | |
| 7,677,939 | B2 | 3/2010 | Dahl | |
| 8,105,125 | B2 | 1/2012 | Sick | |
| D683,414 | S * | 5/2013 | Bell | D21/806 |
| 8,496,506 | B2 | 7/2013 | Wenzel | |
| 2002/0111093 | A1 | 8/2002 | Brown | |
| 2004/0203301 | A1 * | 10/2004 | Johnson | 441/56 |
| 2005/0026518 | A1 | 2/2005 | Bolster | |
| 2005/0124237 | A1 | 6/2005 | Chiang | |
| 2005/0186865 | A1 | 8/2005 | Harwell | |
| 2005/0266745 | A1 | 12/2005 | Wang | |
| 2006/0014450 | A1 * | 1/2006 | Crumrine | 441/70 |
| 2006/0105649 | A1 | 5/2006 | Jones | |
| 2008/0032573 | A1 | 2/2008 | Krikliwy | |
| 2008/0081525 | A1 | 4/2008 | Dahl | |
| 2008/0200083 | A1 | 8/2008 | Balleto | |
| 2008/0214073 | A1 | 9/2008 | Krikliwy | |
| 2008/0242167 | A1 | 10/2008 | Bolster | |
| 2009/0318041 | A1 | 12/2009 | Murphy | |
| 2012/0009833 | A1 | 1/2012 | Doyle | |

FOREIGN PATENT DOCUMENTS

| | | | |
|---|---|---|---|
| CN | 2703551 | Y | 6/2005 |
| CN | 202605652 | U | 12/2012 |
| EP | 1 470 841 | A1 | 4/2004 |
| EP | 2 543 417 | A1 | 1/2013 |
| FR | 2 855 421 | A1 | 12/2004 |
| GB | 2432540 | A | 5/2007 |
| GB | 2443394 | A | 7/2008 |
| GB | 2477363 | A | 8/2011 |

* cited by examiner

SWIMMING PADDLE

FIELD

The present invention relates to hand accessories used in water related activities. More particularly, the present invention relates to a swimming paddle used for strength training in fitness swimming and performance swimming, which can enable a swimmer to swim faster and for longer periods of time when not using the paddle.

BACKGROUND

There are various types of swimming paddles with diverse features and properties for use in pools and in the open water, by competitive athletes, long distance swimmers, surfers, medical rehabilitation patients, and others. Swimming hand accessories are typically used in fitness swimming or in performance training for competitive swimming sports. Such swimming hand accessories can add resistance to a swimmer's hand strokes and thereby provide the strength training that would ultimately allow a swimmer to swim faster and for longer than without the paddles.

Swimming paddles are primarily designed to increase the surface area of a swimmer's hand in order to add more propulsion force that would allow a swimmer to swim faster. Maintaining a higher speed of swimming generally requires more work and sustained exertion of energy from a swimmer, and thus can help build a swimmer's strength. For example, a swimmer attempting to swim at the same high speed without the paddles would tire out faster and be unable to maintain that pace for a long period of time, and thus be unable to build the same amount of muscle as when using the paddles. Thus, while many swimming paddles cause a swimmer to swim faster when in use, they provide secondary benefits in gradual strength training. However, improvements can be made to conventional swimming paddles that, for example, are designed with the primary purpose of increasing swimming speeds, rather than maximizing the resistance load to the swimmer's stroke.

In general, two types of swimming hand accessories are known in the art for the purpose of strength training, increasing speed or improving other aspects of swimming. One type includes webbed gloves or finger webs that attach to some or all of the fingers of the hand, and they aid in swimming by spanning the areas between the fingers to increase the overall surface area at the hands and thus help propel more water. A webbed glove is most effective when the fingers are outstretched so that the increased surface area of the material between the outstretched fingers can propel more water. However, a webbed glove is typically formed by a flexible webbing material that generally conforms to the natural movement of the hands. Thus, there is little rigidity in the glove that can keep the fingers outstretched and prevent the fingers from their natural tendency to come to rest in an unstretched position.

The other main type of swimming hand accessory that overcomes the problem of the webbed glove is a rigid swimming paddle. The rigid body of such a swimming paddle can help increase water displacement and thereby the strength and power required of each swimming stroke. Swimming paddles are formed in a variety of sizes, some that are barely larger than a user's hand, and others that are significantly larger than a user's hand to further increase resistance and strength training. Just as various swimming fins may be worn on a swimmer's feet to increase their effective surface area and add resistance to a swimmer's kick, swimming paddles worn at the hands can also add resistance to a swimmer's stroke and therefore increase the strength of a swimmer's stroke and enhance endurance. Swimming paddles can improve the strength of the upper body in general, and not just the arms. In addition, the additional resistance caused by the paddles can delay early recovery from a stroke, and instead train a swimmer to properly follow through at the end of each stroke before starting a new stroke. Swimming paddles can also facilitate proper hip turning in free style, because if the hips are not turned appropriately, the paddles can hit the thighs.

Existing swimming paddles, however, present a variety of other problems. For example, some conventional swimming paddles are attached to the hands by a strap that is tied by various kinds of knots or securing means, that may be troublesome to adjust or that tend to get loose or unfastened. Some of the straps of conventional swimming paddles are made of materials such as Velcro, which is hard to securely tighten on the hands and is also uncomfortable or irritating to the skin. Moreover, there is often a lot of stress on the strap of conventional swimming paddles, which can cause discomfort or pain to a swimmer and even cause rashes or blisters to form at the wrist or fingers.

Thus, there is a need to address these and other problems to improve swimming paddles as a training accessory for fitness and performance swimming, for the purpose of building the strength that can enable a swimmer to swim faster and for longer periods of time when not using the paddles.

SUMMARY

The present disclosure provides a swimming paddle accessory for building a swimmer's strength in fitness swimming and performance training. More particularly, embodiments of the present invention relate to an oversized paddle body having top and bottom surfaces, proximal and distal sides, and lateral and medial sides. According to an embodiment, a swimming paddle comprises a paddle body having a hand placement portion for placing a hand thereon, and a hand securing portion configured to secure a hand to the paddle body, wherein a portion of a side of the paddle body is scalloped.

According to one aspect, the hand placement portion is recessed relative to surrounding portions of the paddle body.

According to another aspect, a portion of the lateral side and a portion of the distal side of the paddle body are scalloped.

According to another aspect, the paddle body further comprises a flow channel extending across a portion of the bottom surface of the paddle body. The flow channel may extend to an aperture formed through the top and bottom surfaces of the paddle body, the flow channel configured to direct water across the flow channel and through the aperture.

According to another aspect, the paddle body further comprises a plurality of flow channels extending across a portion of the bottom surface, wherein the flow channels extend to a plurality of apertures formed through the top and bottom surfaces of the paddle body, and wherein the flow channels are configured to direct water across the flow channels and through the apertures.

According to another aspect, the hand placement portion is substantially flat relative to adjacent portions near the proximal side of the paddle body for accommodating a wrist or a forearm.

According to another aspect, the paddle body further comprises a finger garage extending from the hand placement portion and embedded into a portion of the paddle body. The finger garage may be configured to accommodate a finger or a plurality of fingers.

According to another aspect, the bottom surface of the paddle body further comprises a rim that protrudes downwards from at least one side of the paddle body.

According to another aspect, the paddle body is formed of a buoyant material. The buoyant material may be an ethylene vinyl acetate (EVA) foam.

According to another embodiment of the invention, a swimming paddle comprises an oversized paddle body having top and bottom surfaces, proximal and distal sides, and lateral and medial sides, the paddle body having a hand placement portion for placing a hand thereon. The swimming paddle may comprise a hand securing portion configured to secure a hand to the paddle body. The paddle body may comprise a first flow channel extending across a portion of the bottom surface of the paddle body. The flow channel may extend to an aperture formed through the top and bottom surfaces of the paddle body, the flow channel configured to direct water across the flow channel and through the aperture.

According to one aspect, the hand placement portion is recessed relative to surrounding portions of the paddle body.

According to another aspect, the flow channel is a planar groove extending from the proximal side of the paddle body to the aperture positioned near the lateral side of the paddle body.

According to another aspect, the aperture is tapered from the bottom surface to the top surface of the paddle body.

According to another aspect, the paddle body further comprises a plurality of flow channels extending across a portion of the bottom surface, wherein the flow channels extend to a plurality of apertures formed through the top and bottom surfaces of the paddle body, and wherein the flow channels are configured to direct water across the flow channels and through the apertures.

According to another aspect, the paddle body further comprises a second flow channel extending across a portion of the top surface of the paddle body.

According to another aspect, a portion of a side of the paddle body is scalloped.

According to another aspect, the paddle body is formed of a buoyant material.

According to another embodiment of the invention, a swimming paddle comprises an oversized paddle body having top and bottom surfaces, proximal and distal sides, and lateral and medial sides. The paddle body may have a hand placement portion for placing a hand thereon. The paddle body may have a hand securing portion configured to secure a hand to the paddle body, wherein a portion of a side of the paddle body is scalloped, wherein the paddle body comprises a flow channel extending across a portion of the bottom surface of the paddle body, wherein the flow channel extends to an aperture formed through the top and bottom surfaces of the paddle body, the flow channel configured to direct water across the flow channel and through the aperture, and wherein the paddle body further comprises a finger garage extending from the hand portion and embedded into a portion of the paddle body, the finger garage configured to accommodate a finger or a plurality of fingers.

According to one aspect, the paddle body further comprises a plurality of flow channels extending across a portion of the bottom surface, wherein the flow channels extend to a plurality of apertures formed through the top and bottom surfaces of the paddle body, and wherein the flow channels are configured to direct water across the flow channels and through the apertures.

According to another aspect, the paddle body is formed of a buoyant material.

DESCRIPTION OF THE DRAWINGS

These and other advantages of the present invention will be readily understood with reference to the following specifications and attached drawings wherein.

DETAILED DESCRIPTION

Embodiments of the present invention will be described herein with references to the accompanying drawings.

Figure 1:
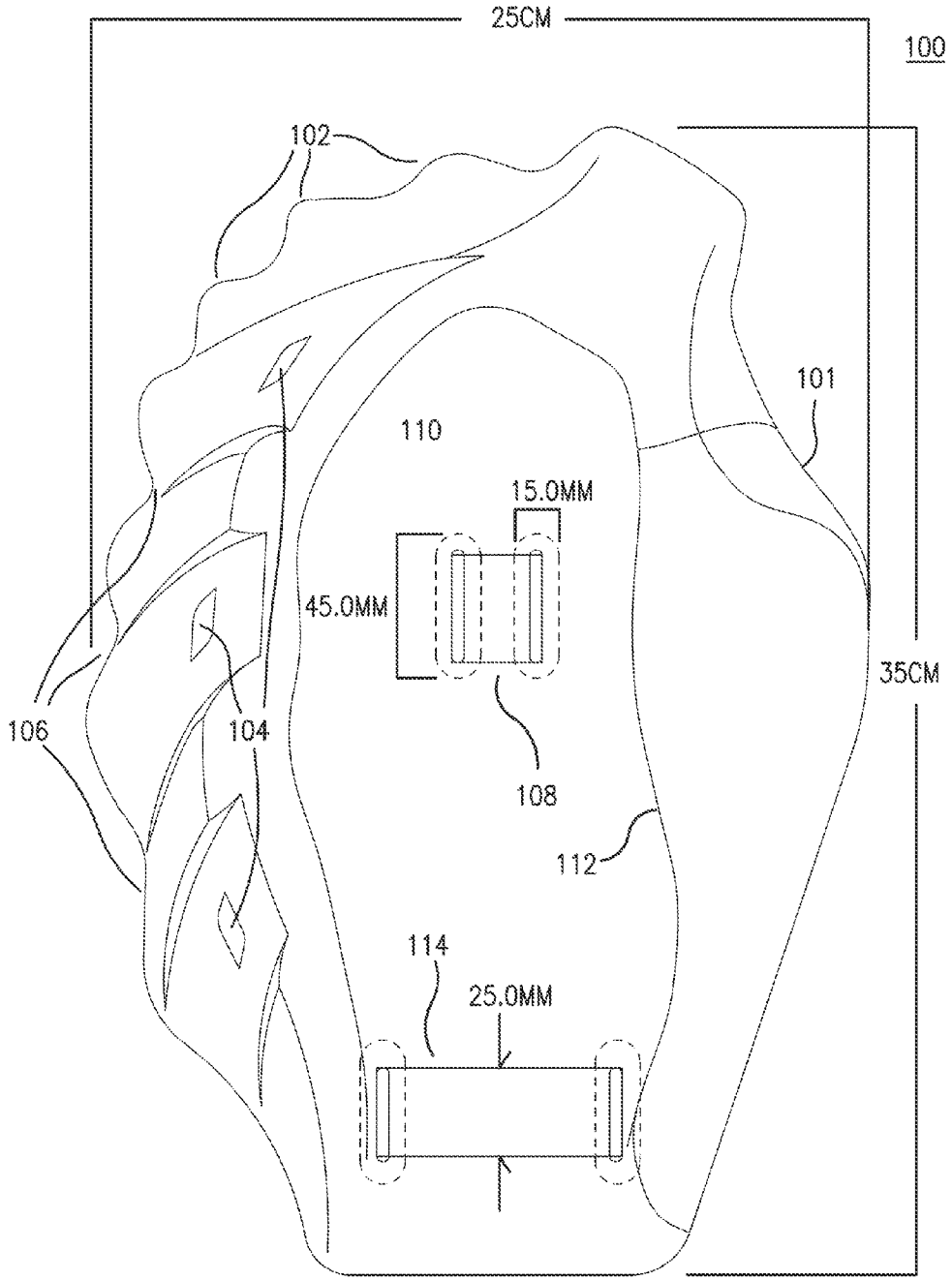
FIG. 1 is a top plan view of a swimming paddle according to an embodiment of the invention.
Figure 2A:
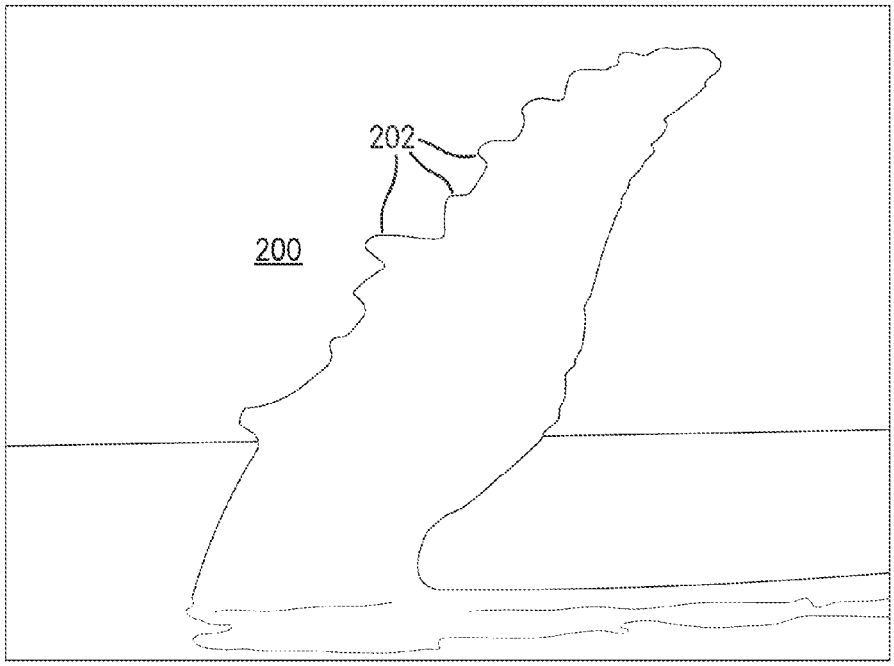
FIG. 2a PRIOR ART
FIGS. 2*a*-2*b* show an illustration and a rendering of a pectoral fin of a humpback whale, as emulated by an embodiment of the invention.
Figure 2B:
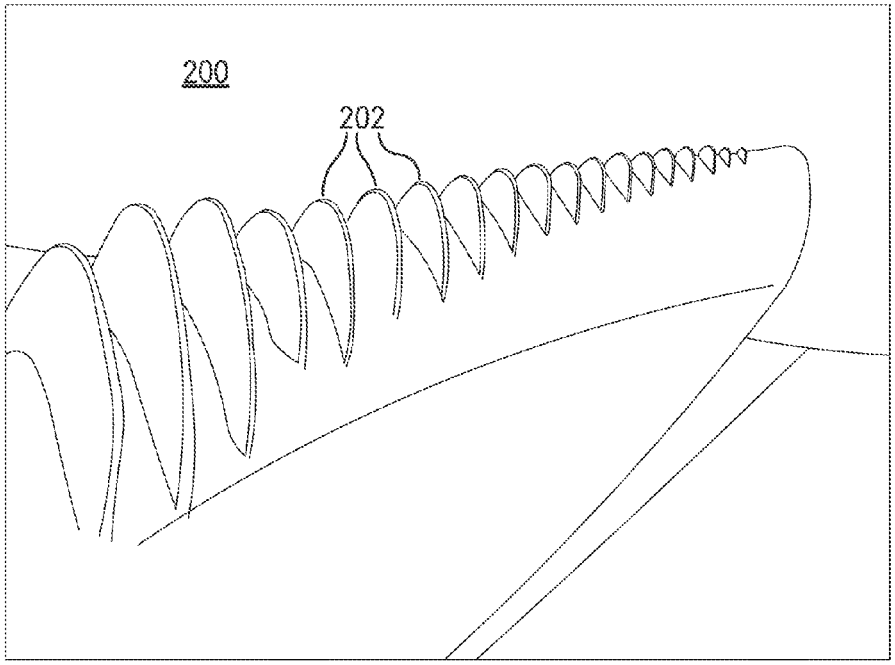
FIG. 2b PRIOR ART

FIG. 1 illustrates a top plan view of a left-hand swimming paddle 100 according to an embodiment of the invention. The swimming paddle 100 has a paddle body 101. According to the embodiment shown, the paddle body 101 is oversized, or larger than a hand to be placed thereon. According to an embodiment, the paddle body 101 may include an irregular edge 102. In particular, the irregular edge 102 has a scalloped shape according to the embodiment shown in FIG. 1, and is designed to emulate the pectoral fin of humpback whales. While other swimming accessories have notably tried to incorporate features of webbing shapes between the fingers to emulate certain aquatic animals, none are known to have focused on the unique characteristics of the humpback whale in particular, nor on a whale's pectoral fin 200 as shown in FIGS. 2*a* and 2*b*. Humpback whales are known for their great speeds, maneuverability and other acrobatic characteristics, which are often associated with their unique pectoral fins. Pectoral fins are believed to be similar to stabilizers or rudders of a ship, and can enable the whale to stop and swim backwards. The humpback whale's pectoral fin is especially unique because it is up to one third of the whale's body length, and is proportionally the longest fin of any marine mammal. But, the most identifiable characteristic of the humpback whale is its pattern of bumps, or 'tubercles', found along the edge of the pectoral fin, as shown by 202 in FIGS. 2*a* and 2*b*.

Figure 2C:
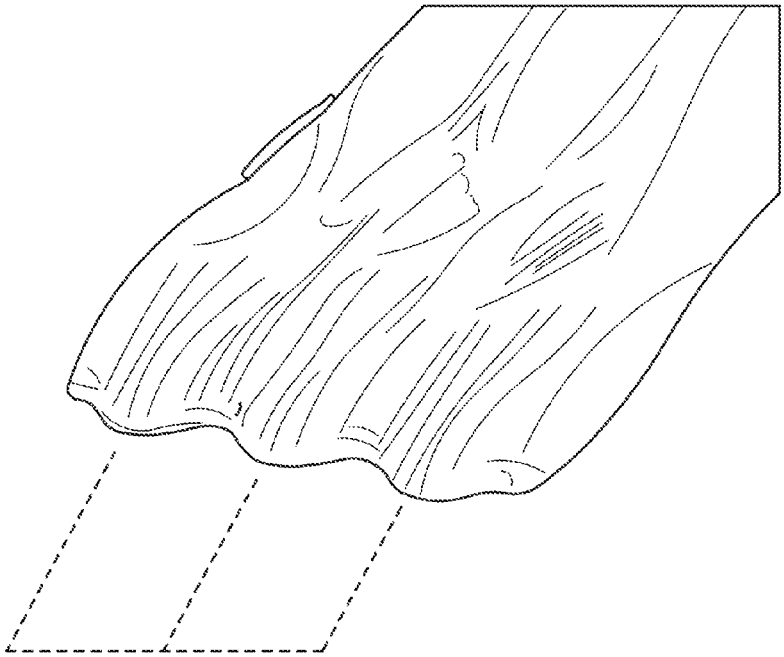
FIG. 2c PRIOR ART
FIG. 2*c* is a perspective schematic view of a pectoral fin of a humpback whale.
Figure 2D:
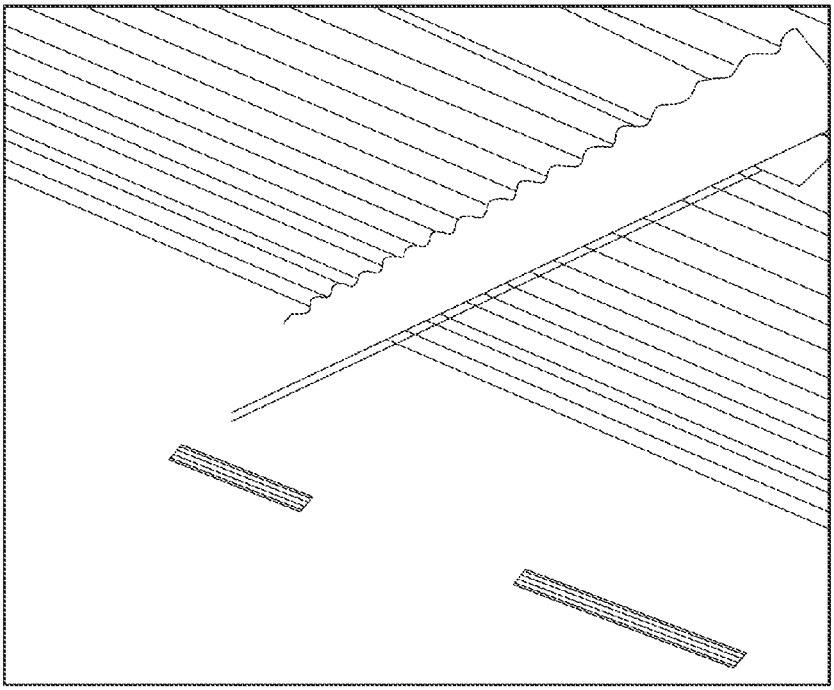
FIG. 2d PRIOR ART
FIG. 2*d* shows a blade manufactured with a scalloped edge for use in turbines and other industrial applications.

Although not limited to theory, it has been reported that the tubercles of the humpback whale's pectoral fins increase propulsion. For example, the tubercles increase the surface area at the edge of the pectoral fin and can thereby cause more water to flow over its irregular edge than over a smooth edge. The increased surface area of the tubercles would thus require the fin to push against more water and accordingly increase propulsion. Moreover, as shown in FIG. 2*c*, large vortices form behind the troughs along the leading edge of a humpback whale's pectoral fin, whereas flow behind the tubercles form straight streamlines. These flow patterns induced by the tubercles are believed to have the effect of significantly improving manueverability. The increased surface area of the tubercles is also believed to be useful for temperature control when the whale migrates between warm and cold climates. Thus, by scaling its unique flow and temperature phenomena in water to that of air, the humpback whale's pectoral fin has inspired biomimicry for various industrial applications, such as the development of large scale scalloped or tubercle-lined blades as shown in FIG. 2*d*. Accordingly, scalloped blades emulating the whale's fins can be seen in wind turbines, hydroelectric turbines, ventilation fans and even helicopters, for the increased aerodynamic and thermal efficiencies they provide.

Figure 3A:
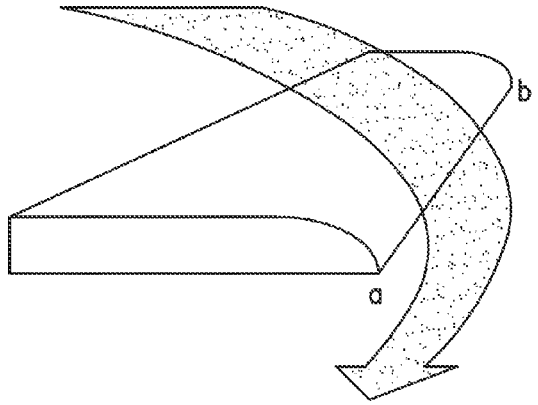
FIG. 3*a* is a perspective schematic view of the direction of flow of a fluid over a straight edge.
Figure 3B:
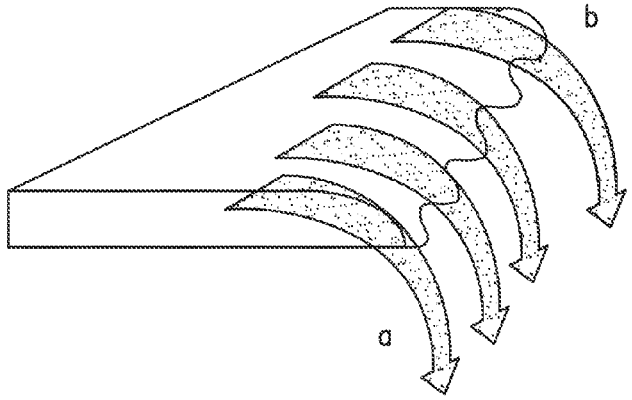
FIG. 3*b* is a perspective schematic view of the direction of flow of a fluid over a scalloped edge.

The scalloped edge 102 according to an embodiment of swimming paddle 100 emulates the pectoral fin of the humpback whale to incorporate its unique properties. In particular, the scalloped edge 102 is believed to provide more surface area than a smooth edge, which can cause more water to flow over the scalloped edge and require the swimming paddle to push against more water than a smooth edge would. For example, a paddle with a straight edge would cause minimal propulsion and minimal lift forces. As shown in FIG. 3*a*, the flow of water would move the shortest possible linear distance, from Point A to Point B. An irregular or scalloped edge, on the other hand, can cause greater propulsion and greater lift by providing more surface area and multiple flow paths, as shown in FIG. 3*b*. Thus, the increased contact surface of an irregular edge can provide greater overall propulsion to a paddle. Accordingly, the irregular edge 102 of a swimming paddle according to an embodiment would ultimately promote greater propulsion force and swimming speed, which in turn must be powered by more strength from a swimmer than a smooth edge would.

In addition, an irregular edge that is scalloped and emulates the shape of a whale's fin is superior to an irregular edge that is webbed, as seen in conventional paddles or gloves. In particular, the scalloped edge breaks water surface tension more efficiently than a webbed edge. A webbed paddle is essentially like a ping pong paddle with inferior surface break geometric characteristics. In contrast, the scalloped edge allows for a lower resistance on its initial entry into water, and thus breaks the surface faster with minimized resistance. Once submerged, the drag created by the scalloped edge can be as efficient or less efficient as a webbed edge; however, there is a significant advantage in the flow of momentum, as a result of the consistent momentum that the scalloped edge creates. For example, when a swimmer's arm is out of the pool and traveling through ambient air, it moves at high speed with minimal resistance. When the swimmer's arm hits the water surface, there is an immediate and sharp decrease in momentum. A webbed paddle is likewise highly disruptive. The scalloped edge, by comparison, does not have as disruptive a loss in momentum, because of its ability to break water tension, and allows for a more uniform arm speed. The webbed edge would afford fast travel in the air, but cause an abrupt stop on water entry and then via the parabolic effect created a rapid increase in speed again through the stroke. The scalloped edge provides the same speed, but allows for more uniform, and less disruptive momentum changes during stroke. Thus, the scalloped edge according to embodiments of the invention provide advantages over the webbed edges of conventional designs.

According to an embodiment, a scalloped edge provides a repeating pattern of generally convex tubercles or protrusions extending from an otherwise planar edge. According to the embodiment shown in FIG. 1, a scalloped edge 102 may be formed by several tubercles or protrusions extending from one portion of a paddle to another portion, for example, along the top (distal) edge and/or along a lateral edge (left, as shown). As shown in the embodiments of FIGS. 1 and 2, the scalloped edge may have at least two rounded protrusions that are approximately the same size. According to other embodiments, the scalloped edge 102 of the swimming paddle may vary in shape, geometry, position, spacing, size, or may vary in the number of tubercules or protrusions. For example, the scalloped edge according to other embodiments may have more, or less, protrusions than as shown in the embodiment of FIG. 1. According to other embodiments, the protrusions may be more closely spaced together, or more widely spaced apart, than as shown in the embodiment of FIGS. 1 and 2.

Figure 4A:
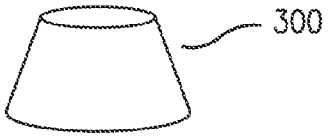
FIGS. 4*a*-4*b* are perspective schematic views of the direction of flow of a fluid over an inverted chamber.
Figure 4B:
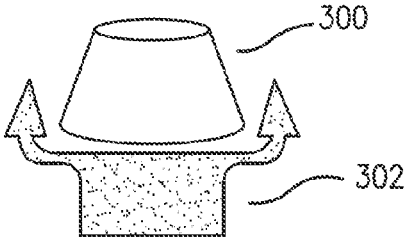

According to another embodiment, the paddle body 101 of swimming paddle 100 include valves, apertures or tapered holes 104 that go through the top and bottom surfaces of the paddle, and positioned near a lateral side (left, as shown) of the paddle. The valves 104 are designed to create greater resistance and buoyancy to the paddle. For example, as shown in FIG. 4*a*, an empty cup or chamber 300 that is placed upside down over air or a fluid can initially provide buoyancy by creating an air pocket inside the cup or chamber. Buoyancy is the upward force that keeps objects afloat and is equal to the weight of fluid displaced by an object. However, such a cup would stop providing resistance once it is completely full of air or fluid inside it because, as shown in FIG. 4*b*, it would form a pressurized parabola that can cause additional air or fluid 302 to flow around the cup 300. Thus, the fluid 302 would submerge the cup 300 and it would lose all of its upward force and its buoyancy.

Figure 4C:
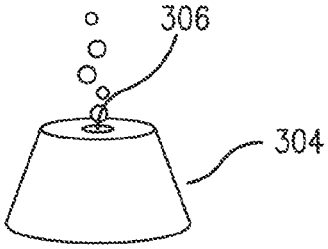
FIGS. 4*c*-4*d* show perspective schematic views of the direction of flow of a fluid over an inverted chamber with a release valve.

In contrast, as shown in FIG. 4*c*, a cup or chamber 304 having an opening or a release valve 306 and that is placed over air or a fluid is not initially as buoyant as the cup 300 without any valve, because air or fluid that collects in the cup 304 will escape through the valve 306. However, the cup 304 will start to form resistance, because the air or fluid 308 must pressurize inside the cup 304 in order to exit through the release valve 306. Thus, the cup 304 with a valve 306 will maintain buoyancy for a longer period of time than the cup 300 without a valve because it will stabilize as additional air or fluid continues to travel out the valve 306, but at a certain constant pressure. The constant pressure of cup 304 caused by release valve 306 provides a constant upward force that must be overcome with greater force than the inherent pressure inside the cavity of a cup 300 without a release valve, for the cup to lose its buoyancy and submerge in a fluid.

Figure 4D:
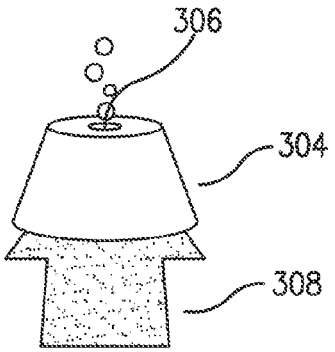

Thus, the valves 104 along a lateral side (left, as shown in FIG. 1) of the paddle body 101 can cause the effect of pressurizing the water that gathers on the underside of the paddle and is forced through the valves, thereby creating greater buoyancy and resistance for the swimmer. According to the embodiment shown in FIG. 1, the valves 104 may be several rectangular holes that are integrated into the paddle near a lateral side. According to another embodiment, the valves 104 may be circular or oval. According to another embodiment, the valves may be tapered to increase in size from a top surface of the paddle to a bottom surface of the paddle, to emulate the shape of the pressurized cup shown in FIGS. 4*c* and 4*d*. According to other embodiments, the valves 104 may vary in shape, geometry, position, spacing, size, or may vary in number. For example, the swimming paddle may have more, or less, valves than as shown in the embodiment of FIG. 1. Moreover, the valves 104 may be formed at various other portions of the paddle, such as near both lateral and medial sides of the paddle and/or near the distal edge of the paddle.

Figure 6:
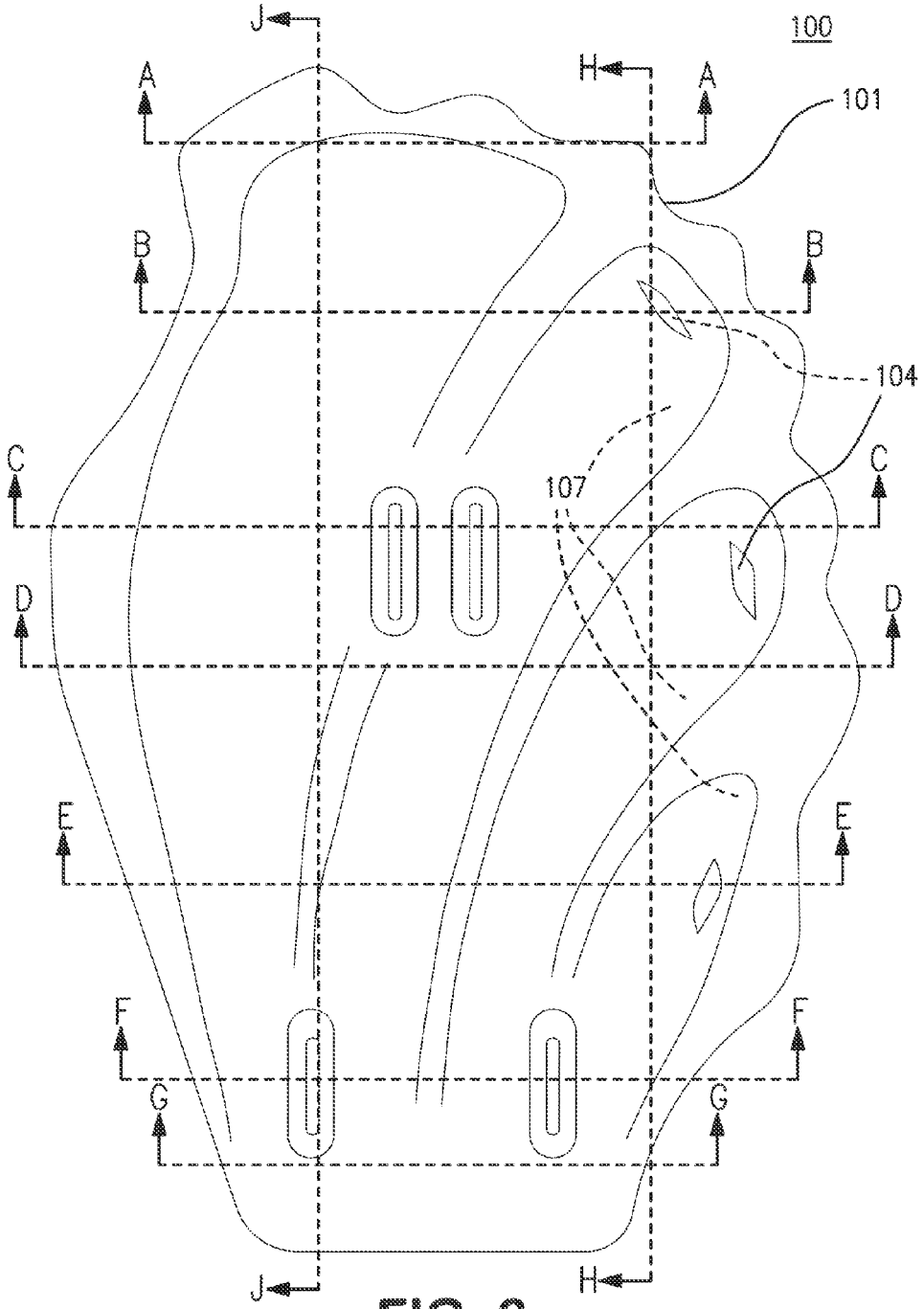
FIG. 6 is a bottom plan view of a swimming paddle according to an embodiment of the invention.

According to another embodiment, the paddle body 101 of swimming paddle 100 may include flow channels across a top and/or bottom surfaces of the paddle body 101. FIG. 1 shows flow channels 106 formed across the top surface of paddle body 101, and FIG. 6 shows flow channels 107 formed along the bottom surface of paddle body 101. Flow channels may be planar grooves configured to guide the flow of water in a desired direction, for example, toward the open valves 104 as shown in FIG. 6. Thus, the flow channels also increase resistance and buoyancy because they guide larger amounts of water to flow through them to be ultimately forced through localized points of pressure at the valves 104, than would occur otherwise on a flat paddle surface without the channels. The flow channels may be formed on both the top and bottom planar surfaces of the paddle body 101, as shown respectively in FIGS. 1 and 6, or alternatively, may be formed on only the top or the bottom planar surface. Flow channels 106 and 107 may also be configured to guide water specifically in a direction that encourages a swimmer to swim and train according to proper swimming form and stroke trajectory such as to avoid, for example, hitting the swimmer's legs with the paddles.

Figure 5:
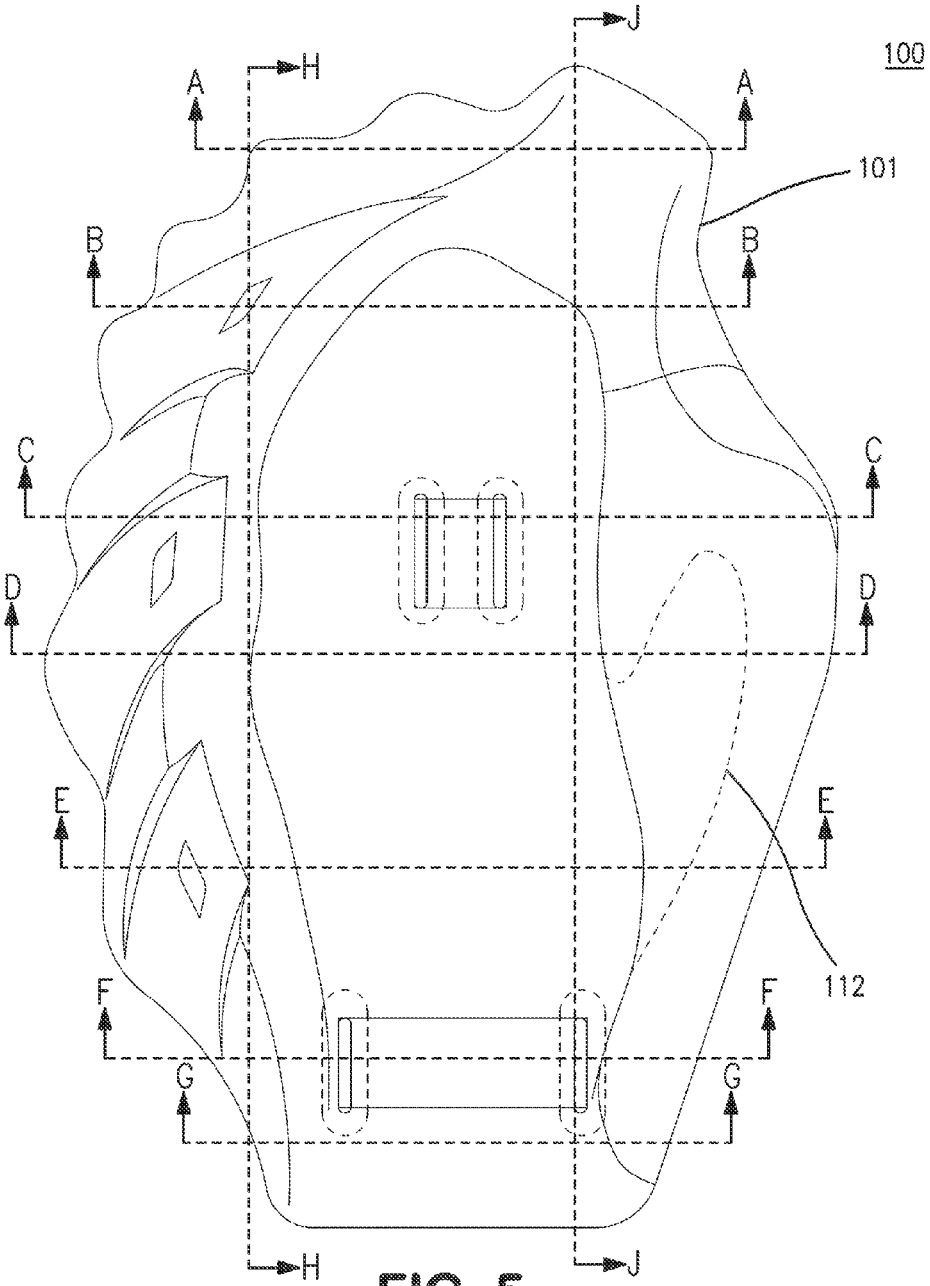
FIG. 5 is a top plan view of a swimming paddle according to an embodiment of the invention.

According to another embodiment, the paddle body 101 of swimming paddle 100 may include a hand placement portion 110, which may be a recessed hand bed, as shown in FIG. 1. The hand placement portion provides stability, comfort and control, particularly given the large size and buoyant properties of the paddle. The paddle body 101 may also include a finger garage 112 as shown in FIGS. 1 (exterior) and 5 (hatched line) for additional support. The finger garage 112, along with the recessed hand bed 110, can provide further stability, secure proper hand positioning, promote better control in maneuvering the paddle and reinforce proper swimming stroke techniques that cause the best propulsion and speed. As shown in FIGS. 1 and 5, the finger garage 112 is designed to house the thumb of a swimmer's hand. The finger garage 112 would provide enough support and control of the swimming paddle, that a swimmer may be able to not use any additional straps, or a smaller number of straps than the swimmer otherwise would need to control and maneuver the paddle without the finger garage 112. Minimizing the time and effort to tie, fasten or adjust one or several straps of a swimming paddle could free up time and energy so that a swimmer can focus more efficiently on training. For example, a swimmer would have more options available to fashion unique swimming spring drills from the use of a paddle that can be easily taken on and off, than the swimmer would have if required to pause for a period of time to put on or take off the swimming paddle.

According to another embodiment, the paddle body 101 may include an additional finger garage for one or more of a swimmer's fingers besides the thumb (not shown) for added support and control. The single or several finger garage(s) can allow a swimmer to use the paddle without any straps that may unfasten, be difficult to put on and tighten, or cause discomfort to the swimmer. According to embodiments, the swimming paddle 100 may include a hand securing portion, such as receptacle 108 and/or receptacle 114 as shown in FIG. 1. According to an embodiment, a receptacle, strap, ring or loop structure for one or more of the fingers, as shown in 108 of FIG. 1, may also be used to attach the paddle body 101 to a swimmer's hand. According to another embodiment, a receptacle, strap, ring or loop structure for the wrist, as shown in 114 of FIG. 1, may also be used to attach the paddle body 101 to a swimmer's hand. The finger receptacle 108 and the wrist receptacle 114 according to embodiments may be made of a smooth and comfortable material, such as a silicone tubing, which is more comfortable than conventional Velcro straps. According to embodiments, the finger receptacle 108 and wrist receptacle 114 may be secured by a silicone piping, D-ring, or other type of adjustable securing means that would eliminate the need for the assistance of a third hand to handle tightening the straps. According to other embodiments, the hand securing portion of the swimming paddle 100 may be integrated to the paddle body 101. For example, the hand securing portion may be in the form of integrated straps, rings, or other securing protrusions, or an integrated hand garage or glove embedded into the paddle body 101.

According to embodiments, the paddle body 101 may be 'oversized' or larger than the size of a human hand. For example, the paddle body 101 according to some embodiments may be significantly larger than, e.g., twice the size of, a swimmer's hand, or sized to cover and support a portion of a swimmer's wrist. According to other embodiments, the swimming paddle may be sized to cover and support a swimmer's wrist as well as a portion of a swimmer's forearm. According to yet other embodiments, the oversized paddle body 101 may extend just past every finger. An 'oversized' paddle that is larger than the size of the hand can provided several advantages to a swimmer. For example, an oversized swimming paddle can add even greater surface area for catching more water during the swim stroke, thus further increase power and propulsion force. In addition, an oversized paddle can further strengthen the arms and upper body, and promote effective swimming techniques by requiring a swimmer to enter the water with very high elbow positions. According to embodiments, a swimming paddle can be configured to further ensure proper swimming strokes and techniques by being shaped to have a relatively narrower width at its proximal end near the wrist. A narrow width at the wrist portion, combined with a strap according to some embodiments, can prevent flexion of the wrists which will cause a swimmer to pull the water back during a stroke with the entire arm (forearm and hand), rather than breaking at the wrist.

Figure 7:
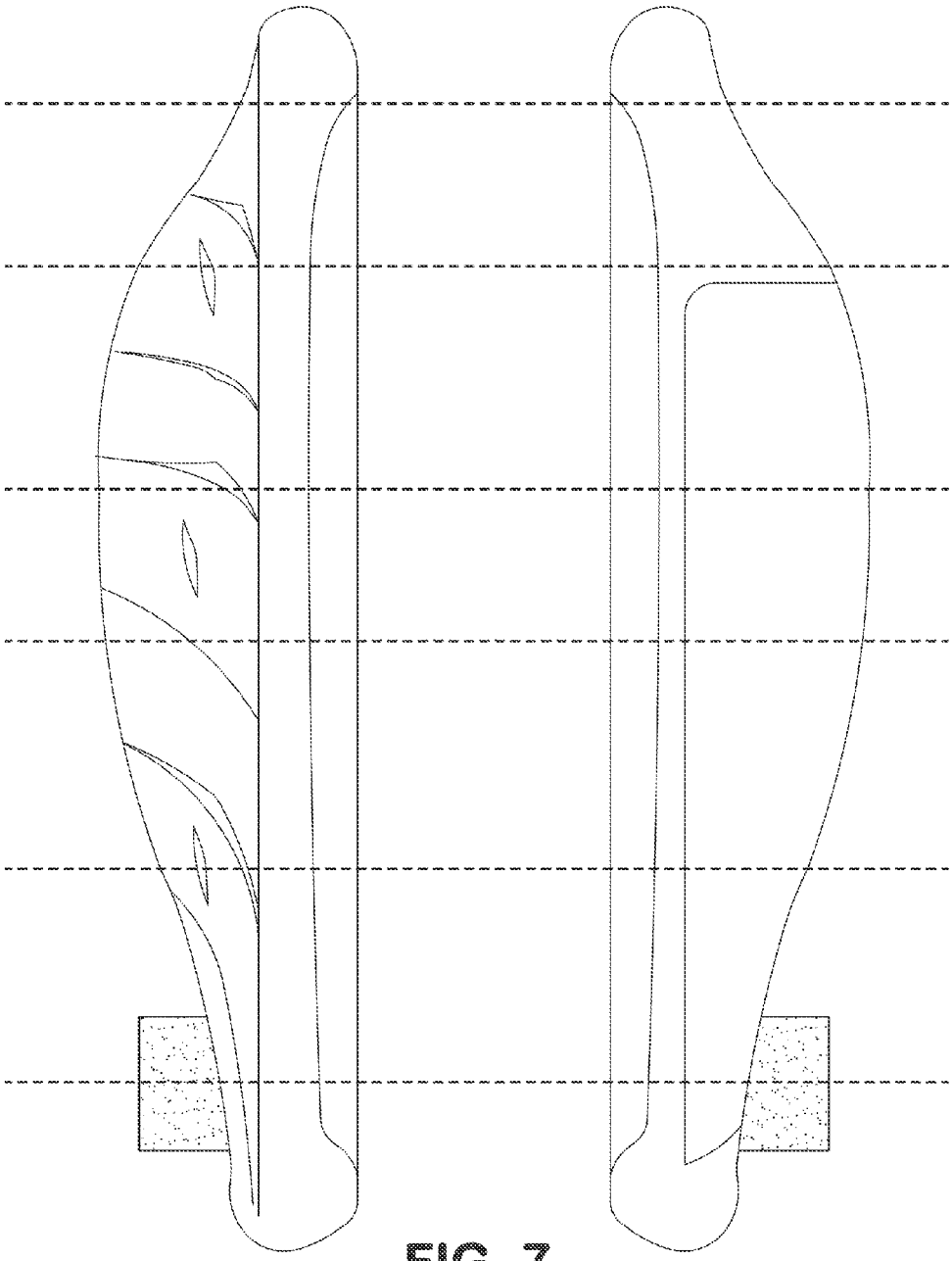
FIG. 7 shows a left side plan view (left) and a right side plan view (right) of a swimming paddle according to the embodiment of FIGS. 5-6.

FIG. 5 shows a top plan view, FIG. 6 shows a bottom plan view, and FIG. 7 shows a left side plan view (left) and a right side plan view (right), of a swimming paddle according to an embodiment of the invention. FIGS. 8*a*-8*i* are cross sectional views of a swimming paddle according to the embodiment of FIGS. 5-7 as indicated by the hatched lines.

Figure 8A:
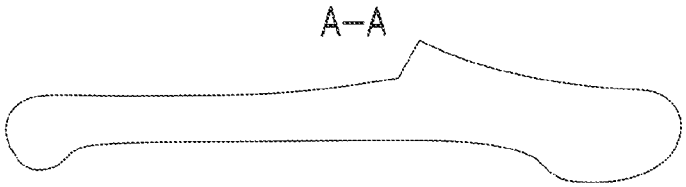
FIGS. 8*a*-8*i* are cross sectional views of a swimming paddle according to the embodiment of FIGS. 5-7 as indicated by the hatched lines.
Figure 8B:
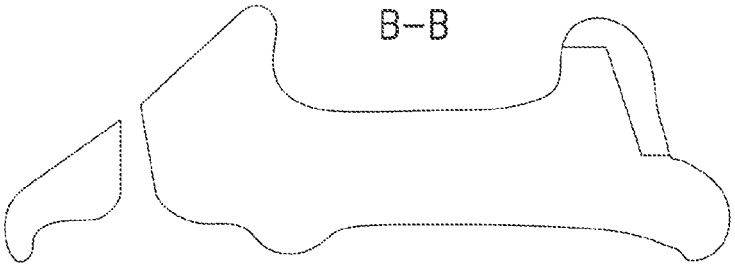
Figure 8C:
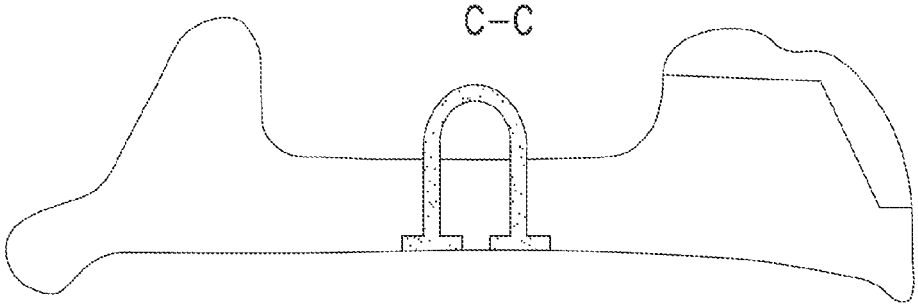

FIG. 8*a*-8*c* show a cross sectional view of the top portion of a swimming paddle at its distal edge, according to an embodiment of the invention. As shown, the paddle body is formed to have an outer lip that extends from the edges of the bottom surface of the paddle. A lip or a rim protrusion that extends from the underside of the paddle may be more advantageous than a paddle with a flat underside by allowing a swimmer to 'catch' more water upon entry on the surface of the water and at the beginning of a stroke. According to embodiments, a rim protrusion is formed along the distal edge of the paddle, as further illustrated for example in the side plan views of FIGS. 8*h* and 8*i*. According to other embodiments, a rim protrusion is formed along the distal edge and along one or both of the lateral and/or medial edges of the paddle body. According to other embodiments, a rim protrusion is formed along the edges of the paddle body that are scalloped (e.g., the distal and/or lateral edges).

FIG. 8*c* shows a cross sectional view of a portion of the swimming paddle that provides for a finger receptacle, strap, ring or loop to attach the paddle body to a swimmer's hand. According to one embodiment, the finger receptacle may be sized to fit one or several fingers. According to another embodiment, the finger receptacle may be adjustable so that a swimmer can choose how many fingers to insert through the receptacle. According to an embodiment, as illustrated in FIGS. 6-7, the finger receptacle may be inserted through the paddle in a loop or ring configuration. Such a finger receptacle may be formed of a smooth material such as silicone, which would be more comfortable to the skin than, for example, conventional Velcro straps. The silicone material for the finger receptacle can be about 3.0 mm in thickness. The finger receptacle may also be formed of wide and flat strap that may provide more comfort than a narrow tubing. According to another embodiment, the finger receptacle may be integrated with the paddle by the same material.

Figure 8D:
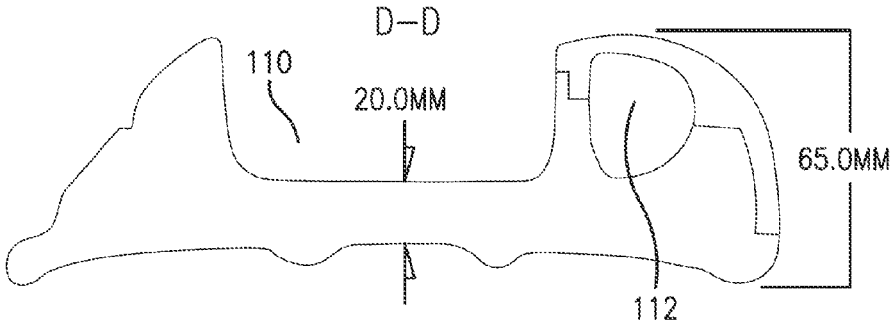
Figure 8E:
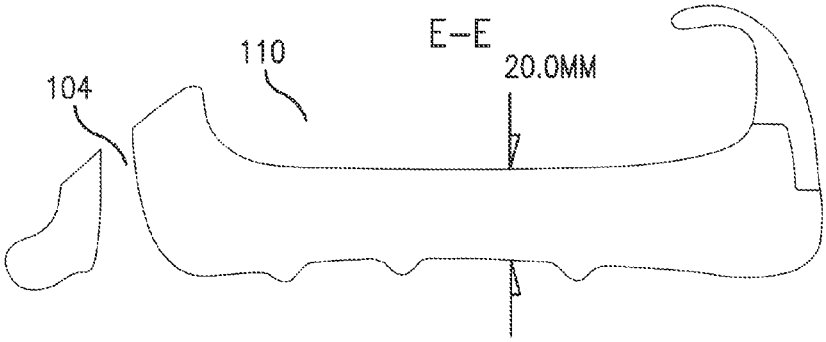
Figure 8F:
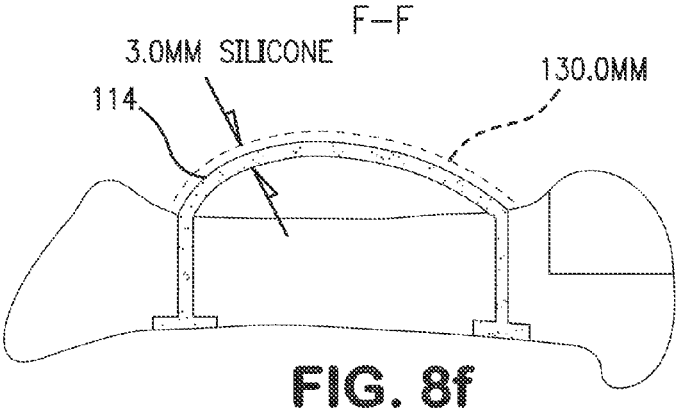
Figure 8G:
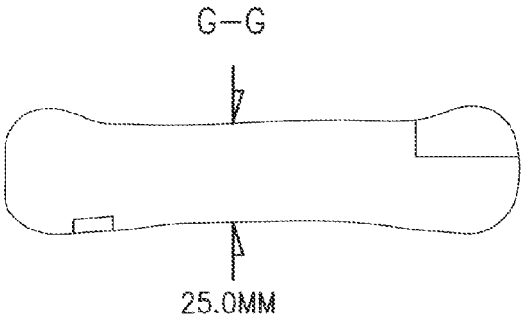
Figure 8H:
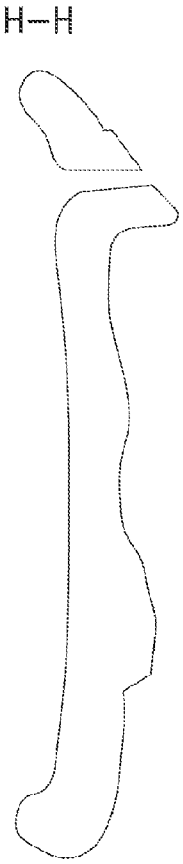
Figure 8I:
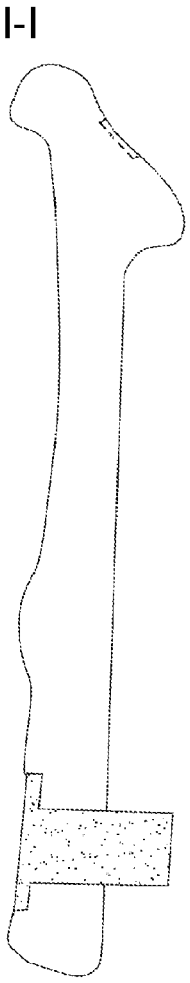

FIG. 8*d* shows a cross sectional view of a portion of the paddle body that provides for a finger garage 112 (e.g., for a thumb). According to an embodiment, the height between the top and bottom surfaces of the paddle body may be about 65 mm at its largest cross sectional height, for example, over the thumb garage 112. This height may vary according to other embodiments. FIGS. 8*d*-8*e* also show cross sectional views of a recessed hand bed at a central portion of the paddle body, which may be at least about 40 mm in depth from the surface of the surrounding sides of the paddle body at its largest cross sectional depth, for example, near the thumb garage 112. This depth may vary according to other embodiments. The recessing of the hand bed diminishes towards the lower portions of the paddle until it largely disappears near the bottom edge of the paddle intended to support a swimmer's wrist, as shown in FIGS. 8*f* and 8*g*. Moreover, the thickness of the paddle body between the top and bottom surfaces at the recessed hand placement portion 110, may be about 20 mm, as shown in FIGS. 8*d* and 8*e*. Likewise, the thickness of the valve 104, as shown in cross sectional view in FIG. 8*e*, may be about 20 mm. The thickness of the paddle body, and the valve, may vary according to other embodiments.

FIG. 8*f* shows a cross sectional view of a portion of the paddle that provides for a hand securing portion, like wrist receptacle, strap, ring or loop 114, to secure the paddle to the swimmer's hand. According to the embodiment shown, the wrist receptacle may be inserted through the paddle body in a loop or ring configuration, and may be adjustable. Such a finger receptacle may be formed of a flexible and smooth material such as silicone. As shown, the silicone material for the wrist receptacle can be about 3.0 mm in thickness. As shown, the wrist receptacle can be about 130.0 mm in length across the top surface of the paddle.

As noted above and addressed by various features according to embodiments of the invention, buoyancy is an important property of swimming paddle. In particular, a swimmer must overcome the resistance caused by the upward force of a buoyant paddle on the "drive-in" phase of the stroke in freestyle swimming during which water is pushed down and backwards, thus propelling the swimmer forward. A buoyant paddle presents a greater challenge to the swimmer to break the water's surface upon entry of the arm downward, which forces the swimmer to develop a more powerful drive-in stroke and provides greater strength training to a swimmer's arms and upper body. A buoyant paddle would also accelerate the back end of a stroke, or the recovery phase in freestyle swimming, by requiring the swimmer to pull the paddle out of the surface quickly and thus rapidly return to the powerful dive-in stroke of freestyle swimming. Training a swimmer to develop such an aggressive drive-in stroke would be very valuable, for example, to a competitive sprinter who needs to exert his or her most powerful strokes in a short period of time.

Moreover, while embodiments of the invention provide for various features to increase the buoyancy of the paddle, swimming paddles according to embodiments may also be inherently buoyant by being made of highly buoyant material. Thus, according to one embodiment, the swimming paddle may be molded from a buoyant material such as an ethylene vinyl acetate (EVA) foam. EVA also has the advantage of being durable, rigid, and not easily subject to fatigue. According to other embodiments, the swimming paddle may be made of other buoyant materials, such as TPR and PE foam. According to other embodiments, the swimming paddle may be made of other materials, including but not limited to polyvinyl chloride, polyethylene, polypropylene, and other rubber and polymeric materials. According to other embodiments, the swimming paddle may include composites or laminates such as fiber glass, reinforced plastic or graphite composites. According to embodiments, the entire swimming paddle may be formed of a single integrated molded material for example, by being molded from conventional injection technology or injection molding technology. The paddle can be of any desired elasticity or stiffness, but is preferred stiff so as to resist stress fatigue.

While the present invention has been described with respect to what are currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation, so as to encompass all such modifications and equivalent structures and functions.

What is claimed is:

1. A swimming paddle for a user, the swimming paddle comprising:

a paddle body having top and bottom surfaces, proximal and distal sides, and lateral and medial sides, the paddle body having a hand placement portion for placing a hand of the user thereon; and a hand securing portion configured to secure the hand of the user to the paddle body;

a plurality of flow channels extending across a portion of the bottom surface, the flow channels extending to a plurality of apertures formed through the top and bottom surfaces of the paddle body, and the flow channels directing water across the flow channels and through the apertures;

wherein a portion of the distal side or the lateral side of the paddle body is scalloped;

wherein the paddle body is sized substantially larger than the hand of the user.

2. A swimming paddle for a user, the swimming paddle comprising:

a paddle body having top and bottom surfaces, proximal and distal sides, and lateral and medial sides, the paddle body having a hand placement portion for placing a hand of the user thereon; and a hand securing portion configured to secure the hand of the user to the paddle body;

wherein the paddle body comprises a plurality of flow channels extending across a portion of the bottom surface of the paddle body, and wherein the plurality of flow channels extends to a plurality of apertures formed through the top and bottom surfaces of the paddle body, the plurality of flow channels directs water across the flow channels and through the plurality of apertures;

wherein the paddle body is sized substantially larger than the hand of the user.

3. The swimming paddle of claim 2, wherein the hand placement portion is recessed relative to surrounding portions of the paddle body.

4. The swimming paddle of claim 2, wherein the flow channel is a planar groove extending from the proximal side of the paddle body to the aperture positioned near the lateral side of the paddle body.

5. The swimming paddle of claim 2, wherein a portion of at least distal side or the lateral side of the paddle body is scalloped.

6. The swimming paddle of claim 2, wherein the paddle body is formed of a buoyant material.

7. A swimming paddle for a user, the swimming paddle comprising:

a paddle body having top and bottom surfaces, proximal and distal sides, and lateral and medial sides, the paddle body having a hand placement portion for placing a hand of the user thereon; and a hand securing portion configured to secure the hand of the user to the paddle body, wherein the paddle body comprises a plurality flow channels extending across a portion of the bottom surface of the paddle body, and wherein the plurality of flow channels extends to a plurality of apertures formed through the top and bottom surfaces of the paddle body, the plurality of flow channels directs water across the flow channels and through the plurality of apertures;

wherein the paddle body is sized substantially larger than the hand of the user;

wherein the aperture is tapered from the bottom surface to the top surface of the paddle body.

8. A swimming paddle for a user, the swimming paddle comprising:

a paddle body having top and bottom surfaces, proximal and distal sides, and lateral and medial sides, the paddle body having a planar hand placement portion for placing a hand of the user thereon; and a hand securing portion configured to secure the hand of the user to the paddle body, wherein a portion of a side of the paddle body is scalloped, wherein the paddle body comprises a flow channel extending across a portion of the bottom surface of the paddle body, wherein the flow channel extends to an aperture formed through the top and bottom surfaces of the paddle body, the flow channel configured to direct water across the flow channel and through the aperture, and wherein the paddle body further comprises a finger garage extending from the hand portion and embedded into a portion of the paddle body, the finger garage configured to accommodate a finger or a plurality of fingers;

wherein the paddle body is sized substantially larger than the hand of the user;

wherein the hand placement portion is recessed from the top surface and from the distal side, the lateral side, and the medial side.

9. The swimming paddle of claim 8, wherein the paddle body further comprises a plurality of flow channels extending across a portion of the bottom surface, wherein the flow channels extend to a plurality of apertures formed through the top and bottom surfaces of the paddle body, and wherein the flow channels are configured to direct water across the flow channels and through the apertures.

10. The swimming paddle of claim 8, wherein the paddle body is formed of a buoyant material.

* * * * *